United States Patent [19]

Fujikawa

[11] Patent Number: 4,921,461

[45] Date of Patent: May 1, 1990

[54] HAIRDRESSING TOY

[75] Inventor: Tsuneo Fujikawa, Tokyo, Japan

[73] Assignee: Tohokako Co., Ltd., Japan

[21] Appl. No.: 335,228

[22] Filed: Apr. 10, 1989

[30] Foreign Application Priority Data

Jun. 14, 1988 [JP] Japan ..... 63-77745[U]

[51] Int. Cl.[5] ..... A63H 3/44

[52] U.S. Cl. ..... 446/296; 446/319; 446/394

[58] Field of Search ..... 446/296, 319, 394, 100, 446/901, 99

[56] References Cited

U.S. PATENT DOCUMENTS

| | | | |
|---|---|---|---|
| 3,116,954 | 1/1964 | Orenstein | 446/296 X |
| 4,070,790 | 1/1978 | Strongin et al. | 446/394 |
| 4,755,141 | 7/1988 | Nakai | 446/901 X |

FOREIGN PATENT DOCUMENTS

| | | | |
|---|---|---|---|
| 2559676 | 8/1985 | France | 446/100 |

*Primary Examiner*—Mickey Yu

*Attorney, Agent, or Firm*—Steele, Gould & Fried

[57] ABSTRACT

The present invention relates to a toy for hairdressing playing use which is capable of training children in the use of scissors and in the modeling of hair styles by cutting hair models attached to a head of doll by hook and loop fasteners with a play pair of scissors.

The hairdressing toy includes a doll to which hook and loop fasteners are attached at fixed places on the surface of the head. A plurality of hair models capable of adhering to the fasteners on the doll's head are provided. One hair model includes several parts which are connected by hook and loop fasteners so that the parts can be cut or separated by the play scissors.

6 Claims, 3 Drawing Sheets

HAIRDRESSING TOY

BACKGROUND OF THE INVENTION

1. Field of the Invention

The present invention relates to a hairdressing toy which is capable of training a child in the use of scissors as the child plays, and more particularly, relates to a toy for hairdressing playing use. The toy is capable of training a child in the use of scissors and in the modeling of hair styles by cutting simulated hair portions which are attached to the head of a doll by fasteners, such as hook and loop fasteners sold under the trademark VELCRO, with a play scissors.

2. Description of the Prior Art

Toys have been developed by prior workers in the art wherein a doll's head has been covered with simulated hair made of woolen or other yarn. Play is performed by cutting this make-believe yarn hair with real scissors.

However, since a toy doll having the customary hair made of yarn uses real scissors, problems are thereby created. Danger exists in using real scissors by infants through school age children in that such inexperienced children could well be injured by such scissors. Further, since the original state of the simulated hair cannot be returned again after the woolen yarn has been cut off with a real pair of scissors, the playing with this toy cannot be repeated many times. Additionally, there are problems in that the portion of the yarn which is cut off once cannot be improved and the like.

SUMMARY OF THE INVENTION

The present invention is quite a new technique that solves the above-mentioned customary problems fundamentally. The toy constructed in accordance with the present invention is constructed by combining a doll to which is attached a plurality of hook and loop fasteners at fixed places on the surface of the head and hair models capable of adhering to the hook and loop fasteners. In one embodiment, the connected hair can be formed by connecting several hair model parts together through hook and loop fasteners in a manner to be cut by toy plastic scissors. Additionally, the present invention relates to a toy in which hair models or the connected simulated hair can be cut off in order from the doll by inserting the toy scissors in between portions of the hook and loop fasteners and then pressing and cutting the above-mentioned portions.

Therefore, by playing with the toy in accordance with the present invention, the hair styles on the head of a doll can be changed by a child without danger, while taking pleasure in sensibility and sound as hair is cut by actually holding and operating a pair of play scissors.

Also, the entire connected hair can be cut off from the head of a doll in the same manner as the above-mentioned model hair. Further, the connected hair can be shortened gradually by cutting off portions of the connected hair by severing at the hook and loop fastener portions thereof.

DESCRIPTION OF THE PREFERRED EMBODIMENT OF THE INVENTION

Figure 1:
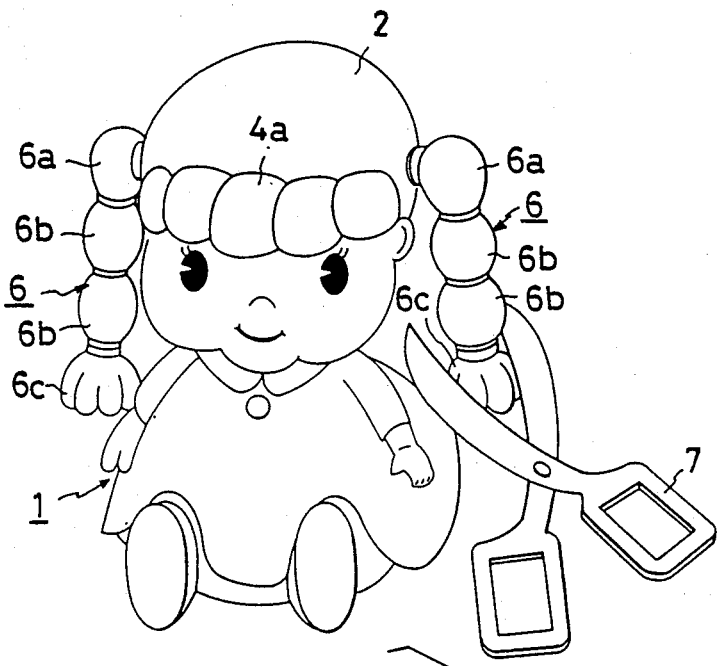
FIG. 1 is a perspective view showing the entire composition of the toy in accordance with the present invention.
Figure 2:
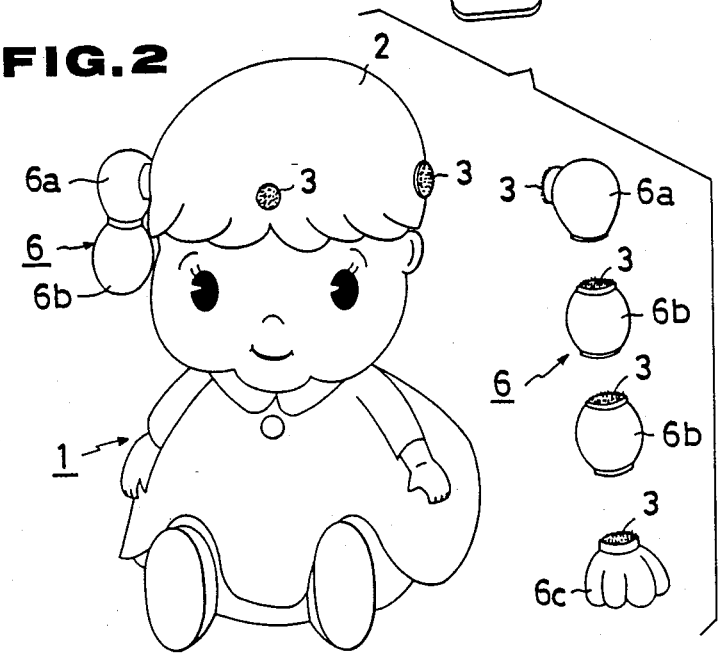
FIG. 2 is a perspective view similar to FIG. 1, with some of the component parts exploded for purposes of explanation of the function of the toy.
Figure 3:
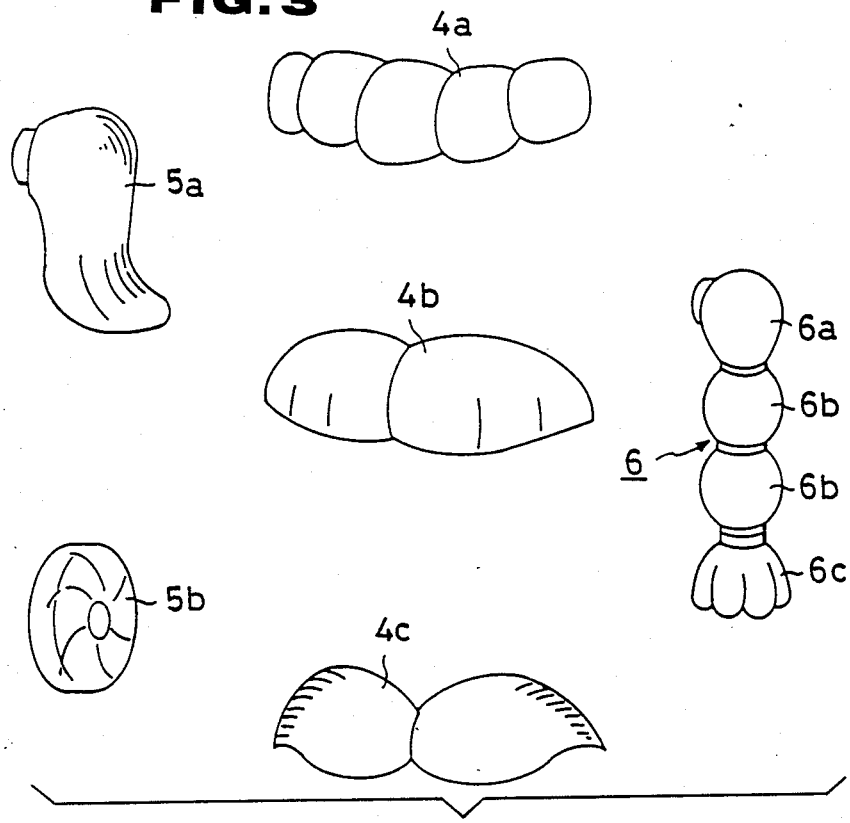
FIG. 3 is a perspective view showing a wide variety of hair models.
Figure 4:
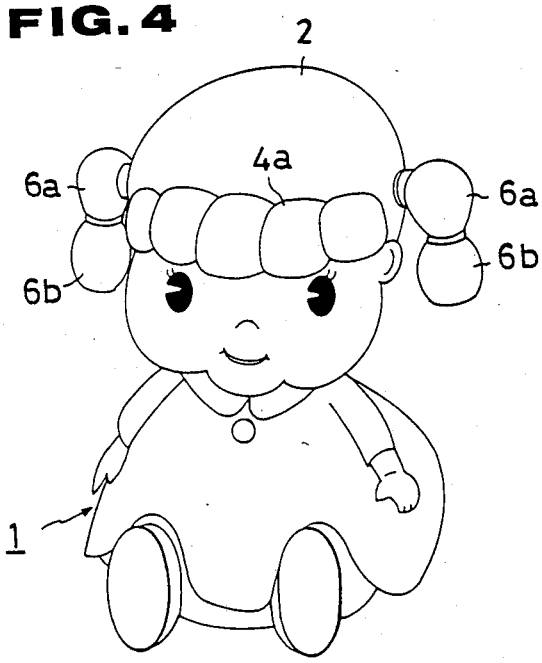
FIGS. 4 to 6 are perspective views showing the various states as the hair models are changed by cutting serially when using the toy scissors.
Figure 5:
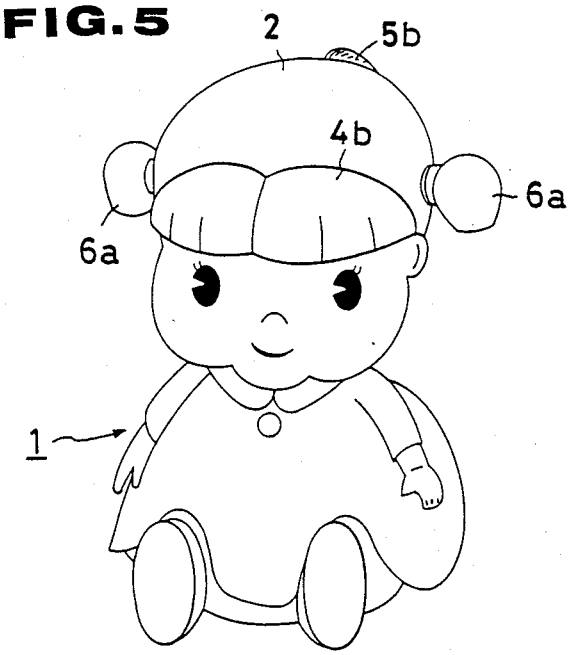
Figure 6:
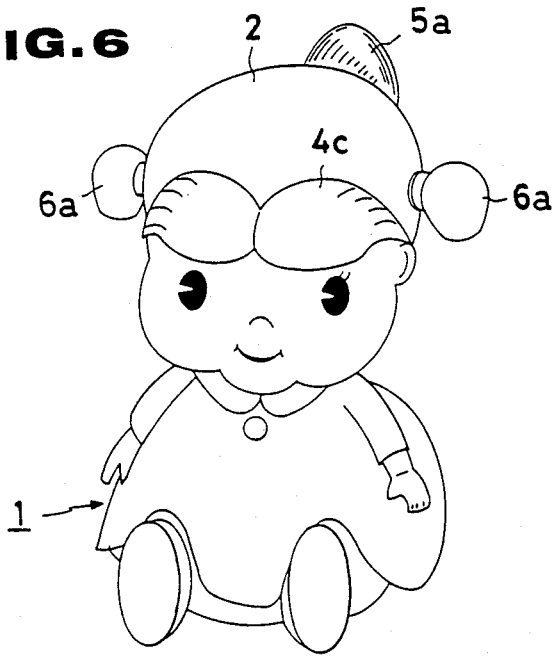

Referring now to a preferred embodiment of the toy in accordance with the present invention, as illustrated in FIGS. 1 and 2, a doll, having a head 2 is shown. A plurality of hook and loop fasteners 3 are attached respectively to the front, the rear and both sides of the head 2. Hair models 4*a*, 4*b* and 4*c* designate hair styles which can be attached to the front of the head 2 of the doll 1 respectively using cooperating hook and loop fasteners. Other fasteners corresponding to the above-mentioned hook and loop fasteners 3 are attached to the back of the hair models 4*a*, 4*b* and 4*c* to facilitate easy engagement and disengagement. Hair models 5*a* and 5*b* designate hair models showing hair styles suitable to be attached to the rear of the head 2 of the doll 1 respectively, and suitable hook and loop fasteners are similarly attached to the hair models 5*a* and 5*b*. Also, a severable hair model 6 designates the connected hair which can be attached to both sides of the head 2. This connected hair 6 is fabricated by connecting in order a plurality of hair model parts 6*a*, 6*b* and 6*c* which are capable of interconnecting through hook and loop fasteners 3. Toy scissors 7 for play use are made of plastic and are furnished to enable a child to get the feel and joy of actually separating parts of the toy.

On the occasion of the use of the toy in accordance with the present invention, either of the front hair models 4*a*, 4*b*, 4*c* or the rear hair models 5*a*, 5*b* which are selected and the connected hair 6 can be adhered to the doll's head 2 by hook and loop fasteners 3 which are arranged at the given places on the head 2 of the doll 1. The above-mentioned front and rear hair models 4*a*, 4*b*, 4*c*, 5*a* and 5*b* and/or the connected side hair model 6 can then be cut off from the head 2 of the doll 1 by inserting the play scissors 7 in the places corresponding to the hook and loop fasteners 3 and by pressing and cutting the above-mentioned hair models. Additionally, the connected side hair model 6 can be shortened by severing or cutting off the discrete, hook and loop fastener connected portions 6*a*, 6*b*, 6*c*.

After the above-mentioned front hair models 4*a*, 4*b*, 4*c* and rear hair models 5*a*, 5*b* are cut off respectively, subsequently the pleasure of playing with the hair models can be repeated by attaching other of the hair models 4*a*, 4*b*, 4*c*, 5*a*, 5*b* to the head 2 to show other hair styles.

Since the hairdressing toy in accordance with the present invention is constituted by attaching the hair models or the connected hair to the head of the doll through the hook and loop fasteners as mentioned above, the hair models or the connected hair can be cut off from the places of the hook and loop fasteners by the play scissors. The method for using the play scissors can be taught to a child, and the touch and the sound created when using the scissors can actually be felt when pressing and cutting the various portions at the hook and loop fasteners by the play scissors.

Further, it is possible that the hair models attached to the head can be selected freely from various different hair styles and the connected hair can be similarly lengthened or shortened. It is possible to train a child to take pleasure in playing with the hairdressing toy by changing the hair styles of the doll freely. The present invention has the inherent capability that this hairdressing toy can be used any number of times together with the fact that the structure is simple in the whole and mass production is possible at a low price.

What is claimed is:

1. A hairdressing toy comprising a doll head having a peripheral surface comprising a front, a rear, a left and right side a plurality of first fasteners affixed respectively to the front, the rear and to both sides of the head at the peripheral surface thereof, a plurality of hair models comprising cooperating second fasteners, the hair models being removably affixed to the peripheral surface of the head at the said first fasteners and a play pair of scissors, the play scissors being adapted to remove the hair models from the head of the doll by severing the parts at the interconnection of the said first and second fasteners.

2. The hairdressing toy of claim 1 wherein the first and second fasteners are hook and loop fasteners.

3. The hairdressing toy of claim 1 wherein at least some of the hair models comprise a plurality of severable parts.

4. The hairdressing toy of claim 3 wherein the severable parts are joined by hook and loop fasteners.

5. The method of playing with a hairdressing doll having a head comprising securing a plurality of hook type fasteners at spaced locations about the head;

applying cooperating loop type fasteners to hair models and attaching discrete hair models to the head at the said hook type fasteners;

providing a play pair of scissors and selectively removing hair models from the head by applying the play scissors at the attached hook and loop fasteners and then pressing the scissors to remove the hair model from the head.

6. The method of playing according to claim 5 and the further step of separating at least some of the hair models into discrete parts, attaching the parts using hook and loop fasteners, applying the play scissors at the said fasteners, pressing the play scissors and separating the hair model parts.

* * * * *